US011046469B2

(12) United States Patent
Monti

(10) Patent No.: US 11,046,469 B2
(45) Date of Patent: Jun. 29, 2021

(54) APPARATUS FOR COLLECTING CONTAINERS IN A FLATTENED CONFIGURATION AND FOR OPENING OUT THE CONTAINERS

(71) Applicant: MARCHESINI GROUP S.P.A, Pianoro (IT)

(72) Inventor: Giuseppe Monti, Pianoro (IT)

(73) Assignee: MARCHESINI GROUP S.P.A., Pianoro (IT)

( * ) Notice: Subject to any disclaimer, the term of this patent is extended or adjusted under 35 U.S.C. 154(b) by 299 days.

(21) Appl. No.: 16/303,041

(22) PCT Filed: May 18, 2017

(86) PCT No.: PCT/IB2017/052945
§ 371 (c)(1),
(2) Date: Nov. 19, 2018

(87) PCT Pub. No.: WO2017/203402
PCT Pub. Date: Nov. 30, 2017

(65) Prior Publication Data

US 2019/0202586 A1 Jul. 4, 2019

(30) Foreign Application Priority Data

May 25, 2016 (IT) ..... 102016000053555

(51) Int. Cl.
*B65B 43/30* (2006.01)
*B65B 43/26* (2006.01)

(52) U.S. Cl.
CPC ..... *B65B 43/305* (2013.01); *B65B 43/265* (2013.01)

(58) Field of Classification Search
CPC ..... B65B 43/265; B65B 43/26; B65B 43/28; B65B 43/285; B65B 43/30; B65B 43/305; B31B 50/76
See application file for complete search history.

(56) References Cited

U.S. PATENT DOCUMENTS 5,415,615 A * 5/1995 Culpepper ..... B65B 43/30 493/315
5,560,473 A * 10/1996 Ivancso, Jr. ..... B65G 17/26 198/803.11

(Continued)

FOREIGN PATENT DOCUMENTS

JP 2008 254815 A 10/2008
JP 2015 157650 A 9/2015

*Primary Examiner* — Thanh K Truong
*Assistant Examiner* — Katie L Gerth
(74) *Attorney, Agent, or Firm* — R. Neil Sudol; Henry D. Coleman

(57) ABSTRACT

Container collecting and opening apparatus includes a store holding containers in a flattened configuration; an extracting device for extracting the flattened containers from the store and arranging them in a waiting position; and a transfer device movable between, a first, upstream, position for collecting containers from the waiting position and a second, downstream, position for releasing the containers. A container-opening device includes an abutment and a gripper positionable by the transfer device in a position along a container transfer pathway between the first position and the second position, so that the abutment is abutted by the container being opened and the gripper retains the opened-out container. A collecting device collects the container opened out by the container-opening device and transfers the opened-out container by rotating it with the axis thereof vertical to a crate of a packing line, while maintaining the container in the opened-out configuration.

12 Claims, 11 Drawing Sheets

(56) References Cited

U.S. PATENT DOCUMENTS

| | | | | |
|---|---|---|---|---|
| 6,484,479 | B1 * | 11/2002 | Minion | B65B 43/265 53/565 |
| 7,310,925 | B2 * | 12/2007 | Monti | B65B 59/003 53/566 |
| 7,568,325 | B2 * | 8/2009 | Monti | B65B 43/46 493/309 |
| 8,297,029 | B2 * | 10/2012 | Iwasa | B31B 50/00 53/377.3 |
| 8,986,183 | B2 * | 3/2015 | Monti | B65B 43/52 493/315 |
| 9,334,070 | B2 * | 5/2016 | Till | B65B 35/56 |
| 10,351,280 | B2 * | 7/2019 | Prahm | B65B 35/10 |
| 10,689,205 | B2 * | 6/2020 | Iwasa | B65G 47/261 |
| 2004/0000121 | A1 * | 1/2004 | Ichikawa | B65B 5/105 53/173 |
| 2009/0247380 | A1 * | 10/2009 | Monti | B65B 43/305 493/315 |
| 2013/0199135 | A1 * | 8/2013 | Monti | B65B 43/08 53/564 |
| 2016/0332761 | A1 * | 11/2016 | Yokota | B31B 50/52 |
| 2018/0370668 | A1 * | 12/2018 | Iwasa | B65B 43/60 |
| 2019/0263545 | A1 * | 8/2019 | Yokota | B65B 35/30 |

* cited by examiner

PRIOR ART

APPARATUS FOR COLLECTING CONTAINERS IN A FLATTENED CONFIGURATION AND FOR OPENING OUT THE CONTAINERS

FIELD OF THE INVENTION

The present invention relates to the technical sector concerning automatic machines for packaging products, for example cosmetics products, internally of relative containers.

DESCRIPTION OF THE PRIOR ART

In this particular technical sector, the containers are supplied in a flattened form and stored in a relative store, then to be collected and opened-out, then to be transferred into the packaging line for inserting of the product internally of the open container.

In this regard, the containers are formed by a tubular blank, for example cardboard or card, comprising a series of folding lines, usually four folding lines, so that it can be folded at the folding lines and assume a flattened shape so as to enabling storage thereof, arranged one flanked to another, internally of a store.

The containers, in this flattened configuration, thus comprise two sheets connected to one another at relative ends, at which two folding lines are present, the sheets being folded with respect to the folding lines so as to be superposed on one another and facing one another.

Further, in each of the two superposed sheets of the container in the flattened form, there is a further folding line so that two flanked faces are identified, which will then constitute two respective consecutive walls of the containers once opened out.

At the other two ends of the two sheets there are flaps which, once the container has been opened out, are foldable with respect to the walls of the container (obtained by the faces of the two above-mentioned sheets) so as to close the heads of the container.

The present invention in particular regards an apparatus for collecting the containers in the flattened configuration from a relative store, so as to open out the containers and then transfer the opened-out containers to a packaging line of the products internally of the containers.

Once collected from the relative store, the opened-out containers have to be arranged vertically at the packaging line, i.e. have to present at least an open head facing upwards, to facilitate the product-inserting operations.

For this technical reason, the apparatus for collecting the flattened containers from their store, and the opening-out thereof, have to be designed so as to be able to arrange the open container vertically, when it is transferred to the packaging line.

An apparatus of known type, which collects the flattened containers, opens them out and then transfers them to a packaging line, is described for example in document EP 1.916.191, in the name of the same Applicant.

The apparatus comprises, as is for example illustrated in FIGS. 1A, 1B and 1C, a first gripping means (9), of the suction or aspirating type, borne by a movement group (91) which is predisposed so as to activate and move the gripping means (9) so that the gripping means (9) can perform roto-translations in space.

The movement group (91) is predisposed and configured for moving the first gripping means (9) so that it can abut, and retain by gripping, a flattened container from a store of the containers at a face of the first sheet, the lower sheet, of the flattened container, extracting the container (A) from the store and bringing the container (A), still in the flattened configuration, and following a roto-translation in space, into a vertical configuration in a position facing a crate (C) of a packaging line.

The apparatus also has a second gripping means (92), again of the suction or aspirating type, which is predisposed so as be rotatable about a vertical axis and which is positioned at the position in which the first gripping means (9) arranges and maintains the flattened container (A) vertical and facing the crate (C) of the packaging line.

The second gripping means (92) is activatable in rotation, in a first rotation direction, for abutting and retaining, by gripping, the second sheet of the container, being the sheet opposite the first sheet with which the container (A) is maintained vertical by the first gripping means (9), and in particular for abutting and retaining, by gripping, the face of the second sheet which is hinged, by a folding line, to the face of the first sheet retained by the first gripping means (9).

The second gripping means (92) is activatable in rotation, according to a rotation direction opposite the first rotation direction, for detaching and distancing the face of the second sheet from the face of the first sheet retained by the first gripping means so as to open out the container (see FIG. 1C).

Once the container (A) has been opened out following the above-described operations, and is therefore arranged vertically with the upper head open, the container is translated horizontally and inserted in the crate (C) of the packaging line, for carrying out the operations of inserting the product and closing the heads of the container.

This horizontal translating operation is carried out by a mobile arm (93) provided with gripping means, of the suction or aspirating type, which abuts, retains by gripping the lateral wall of the container (S) facing towards the crate (C) of the packaging line, and translates the containers (A) into the relative crate (C)(see FIG. 1C).

This apparatus has been seen to be effective in carrying out the collection, opening and transfer operations of the opened-out container in the vertical configuration to the packaging line as long as the working speeds are not very rapid.

The performance of this apparatus has however been observed to be less than optimal when medium-to-high speed operations are required.

This is caused by the fact that the second gripping means (92) must be activated in rotation about the relative vertical axis in the two rotation directions, with a relatively high frequency, and the mobile arm (93) has to be translated, in opposite directions, with high speeds and it has been observed that these operative procedures can cause an onset of vibrations that have a negative effect on the correct maintaining and positioning of the containers.

SUMMARY OF THE INVENTION

The aim of the present invention is therefore to provide a new apparatus for collecting the containers in the flattened configuration, for the opening-out of the containers, able to ensure high operating velocities and guarantee the correct maintaining and positioning of the containers and, at the same time, preserving the integrity and the appearance of the externally-visible lateral walls of the containers once opened-out.

The above-mentioned aims are obtained by an apparatus for collecting containers in a flattened configuration and for opening out containers, according to the contents of claim 1.

Other advantageous characteristics of the apparatus disclosed by the present invention are set out in the dependent claims.

BRIEF DESCRIPTION OF THE DRAWINGS

The characteristics of a preferred, but not exclusive, embodiment of the apparatus for collecting containers in a flattened configuration and for the opening-out of the containers of the present, invention will be described in the following with reference to the appended tables of drawings, in which.

DESCRIPTION OF THE PREFERRED EMBODIMENTS

Figure 1A:
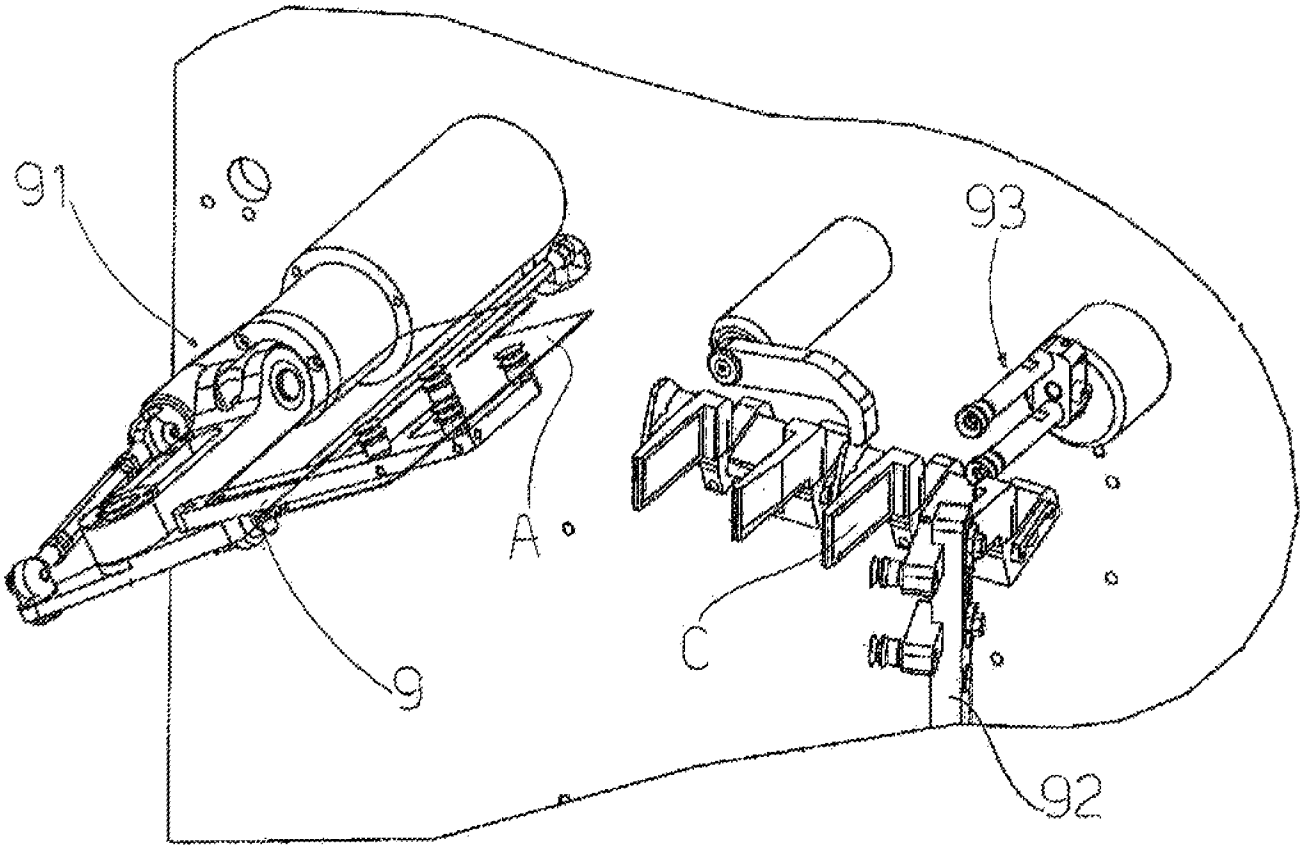
FIG. 1A, already mentioned in the foregoing, illustrates, in a perspective view, an apparatus of known type described in document EP 1.916.191 as mentioned in the foregoing, for opening-out flattened containers.
Figure 1B:
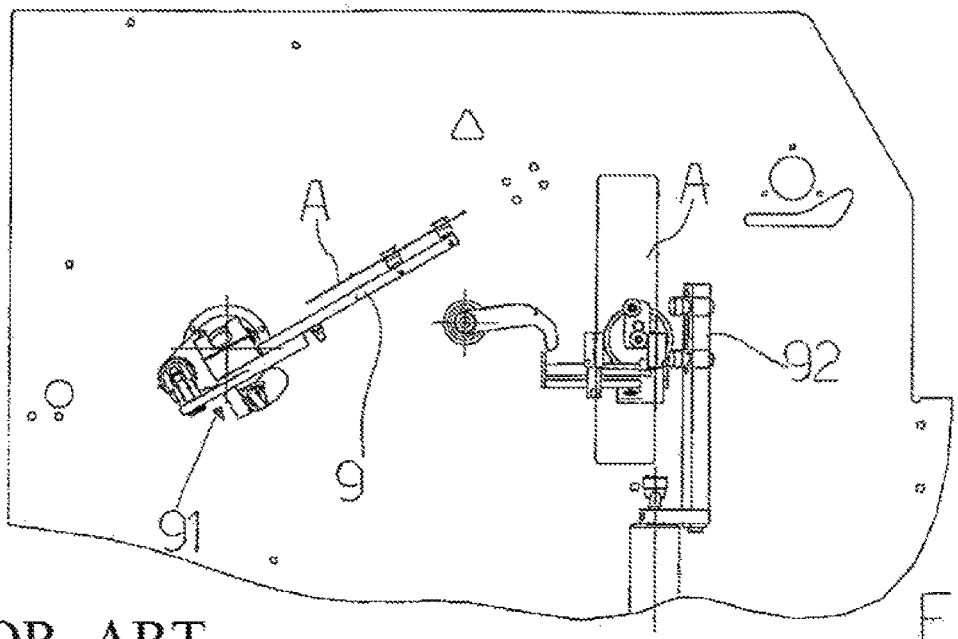
PRIOR ART FIG 1B
FIGS. 1B and 1C, also mentioned herein above, illustrate, in respective front and plan views, the apparatus of FIG. 1A.
Figure 1C:
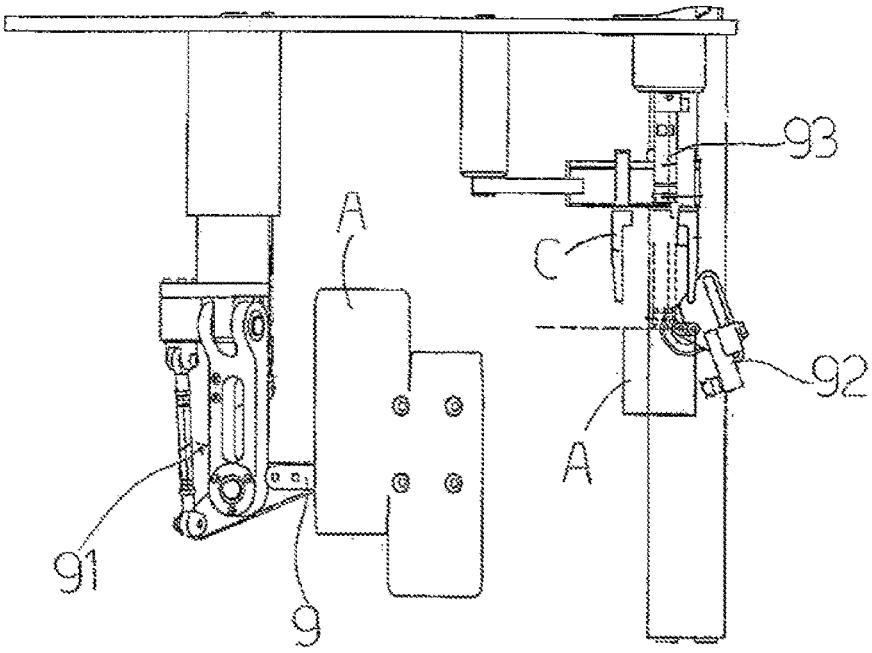
PRIOR ART FIG 1C
Figure 2:
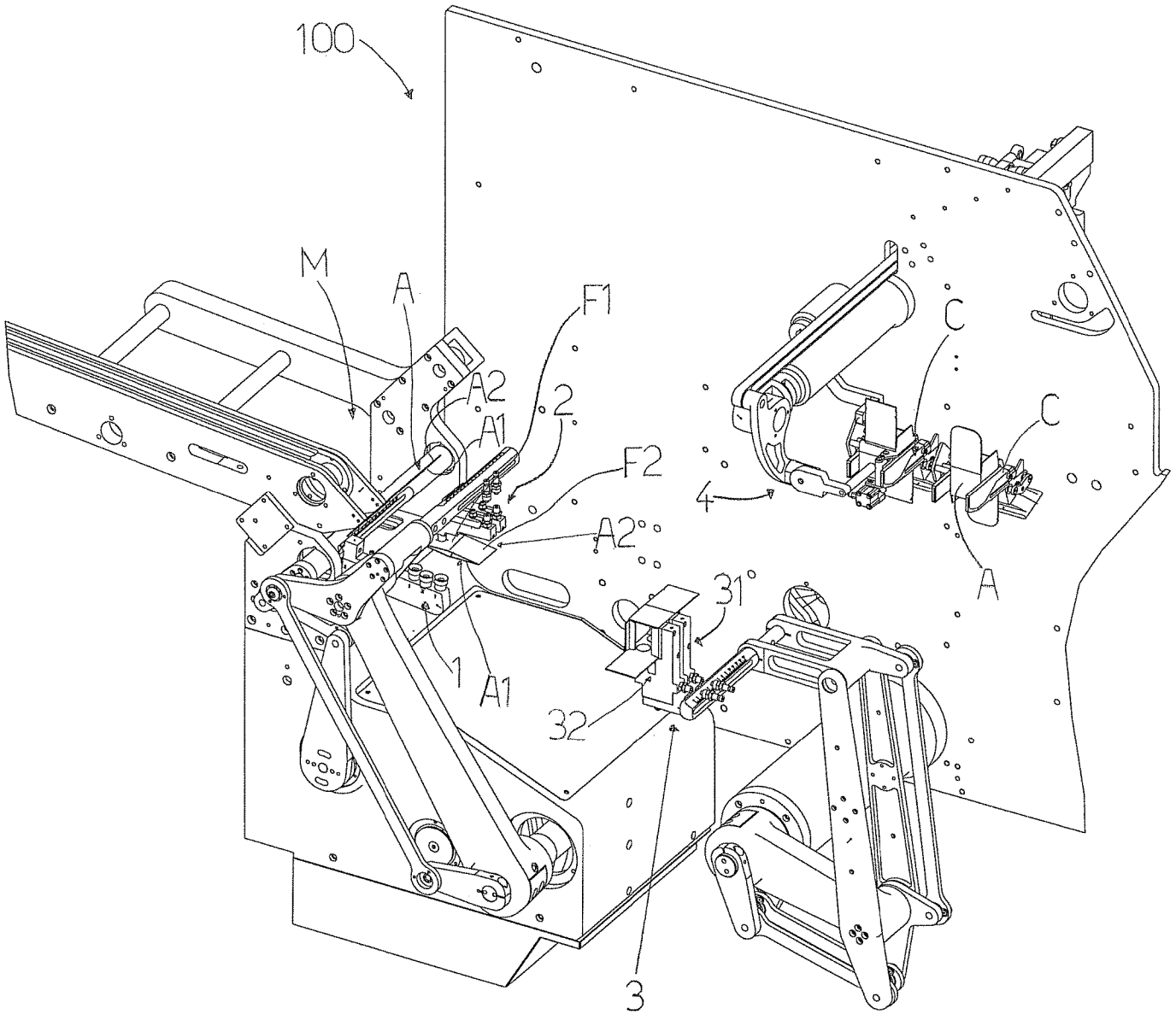
FIG. 2 is perspective view of the apparatus for collecting containers in a flattened configuration and for opening-out the container of the present invention, represented during its operating cycle.
Figure 3A:
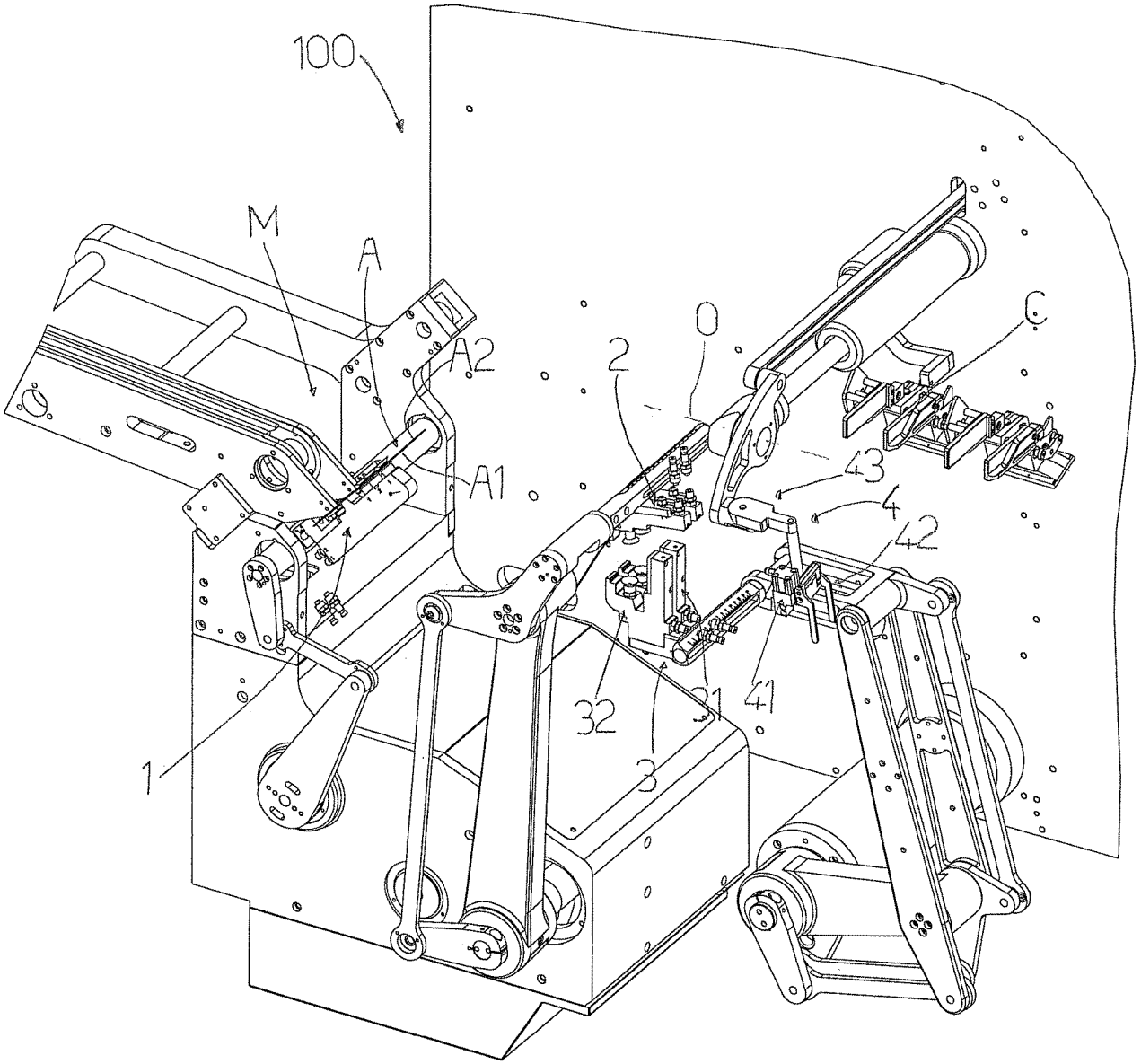
FIGS. 3A to 3H illustrate, according to respective perspective views, a particular operating sequence of the functioning of the various components of the apparatus of the invention, starting from a collecting step of a container in the flattened configuration, up to the step of transferring it to a packaging line of an opened-out container in a vertical configuration.
Figure 3B:
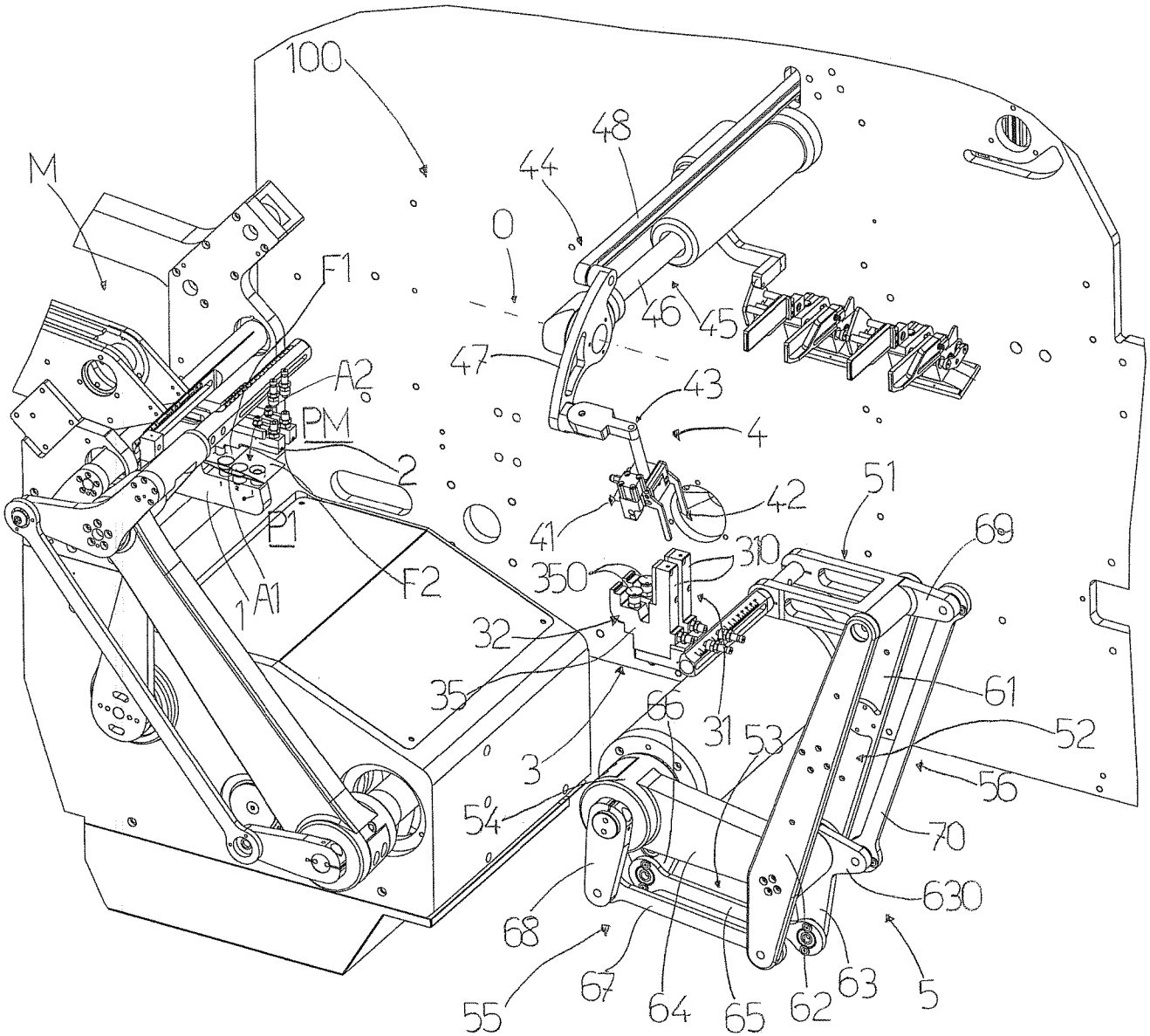
Figure 3C:
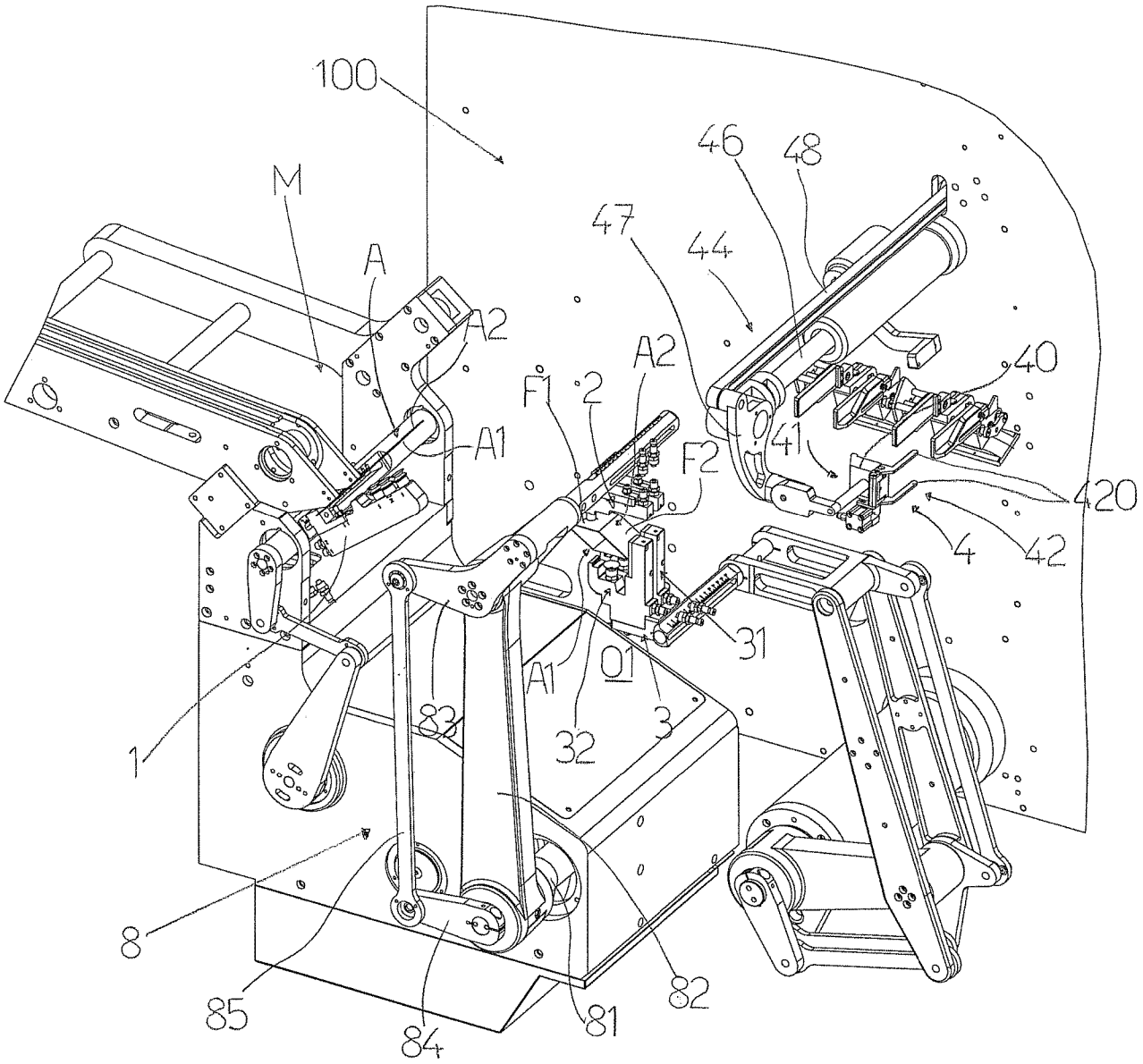
Figure 3D:
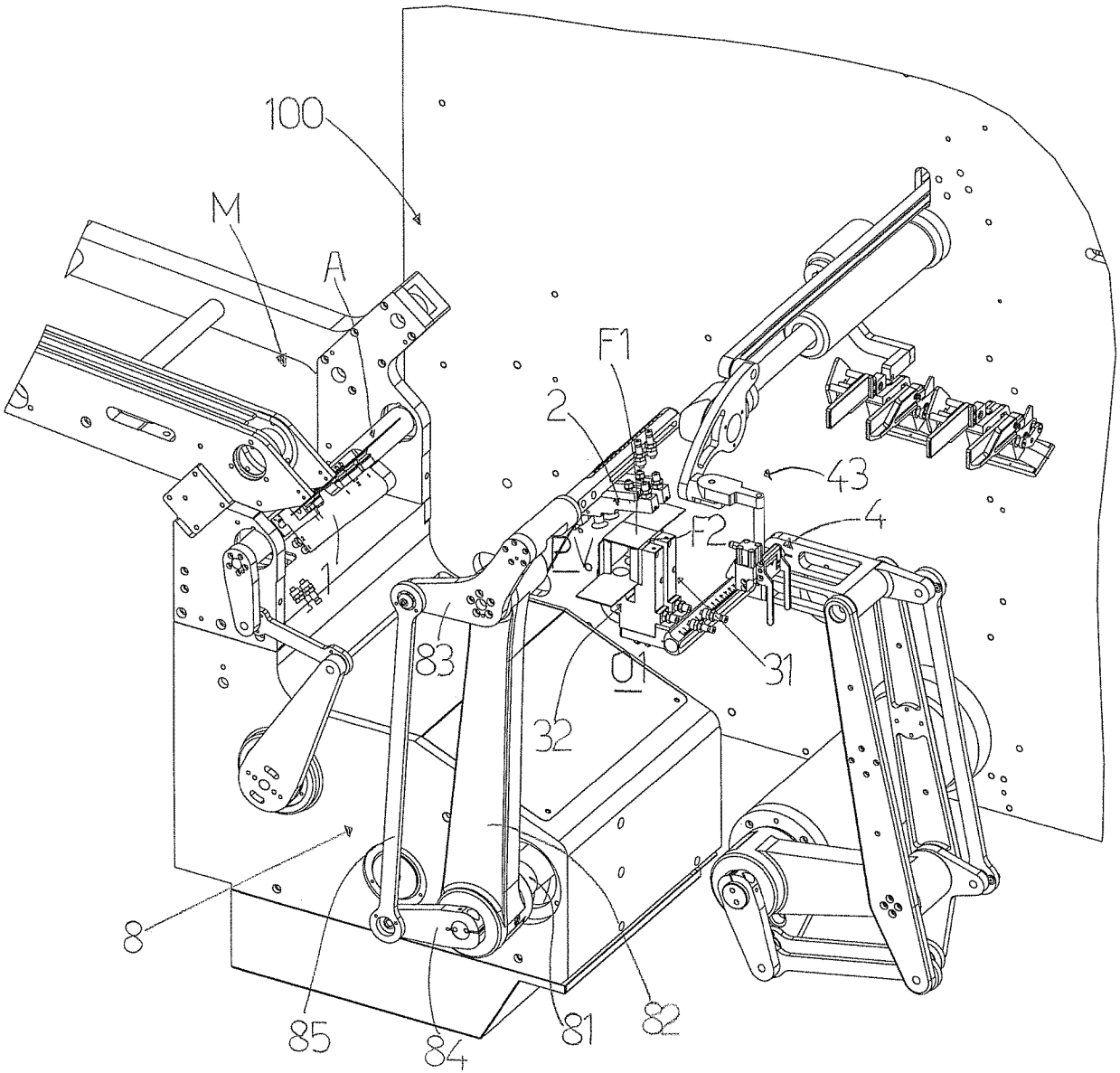
Figure 3E:
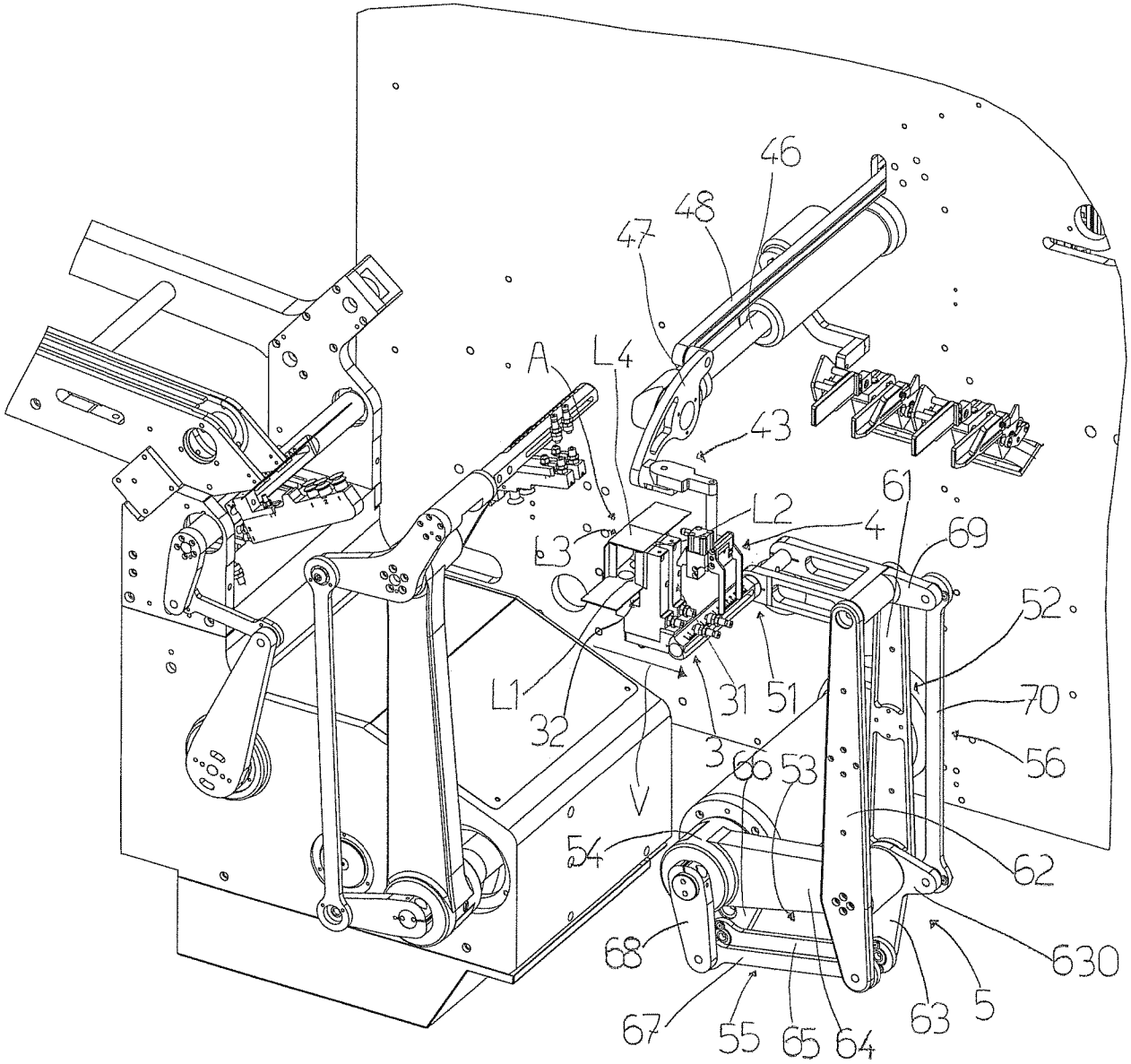
Figure 3F:
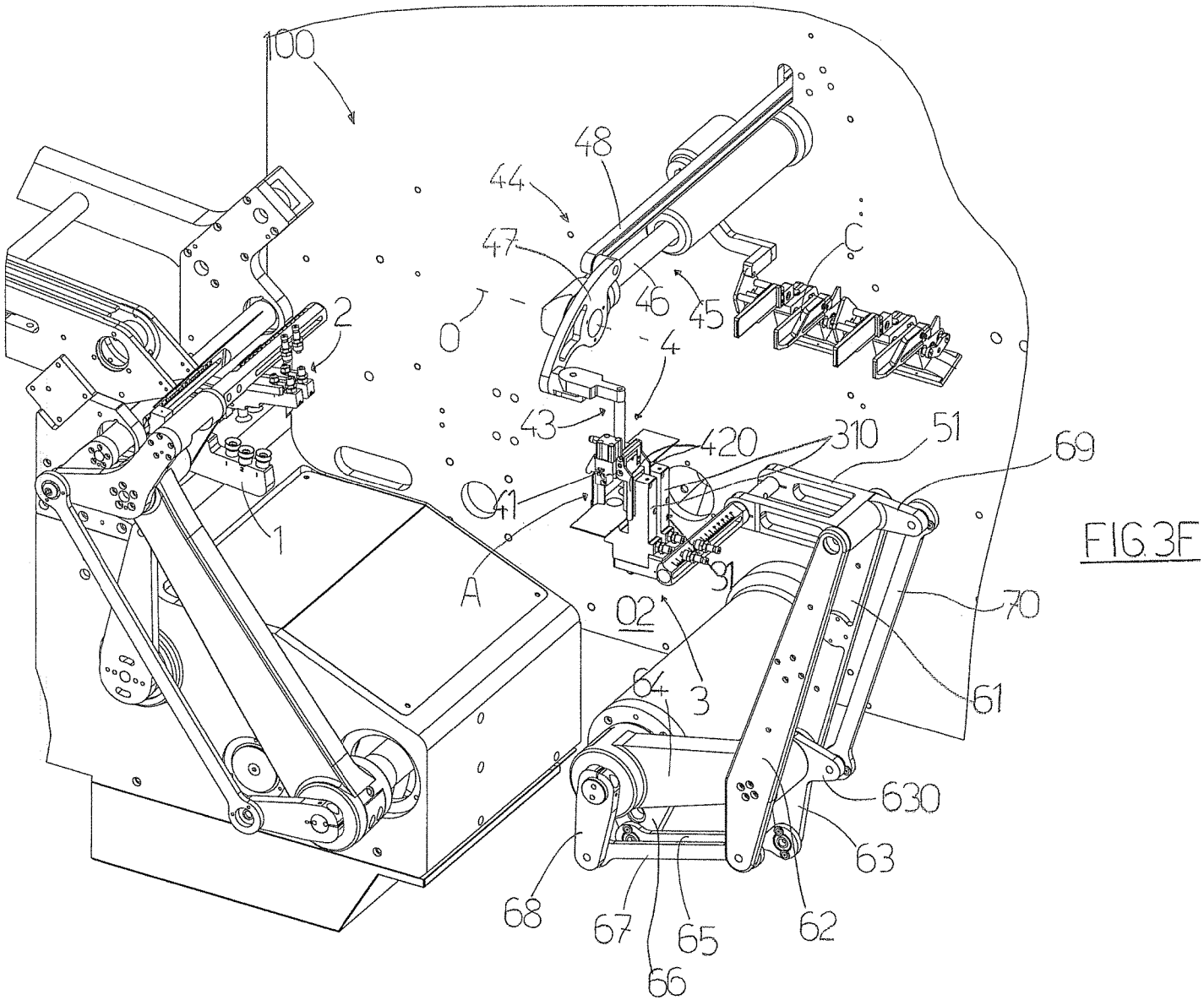
Figure 3G:
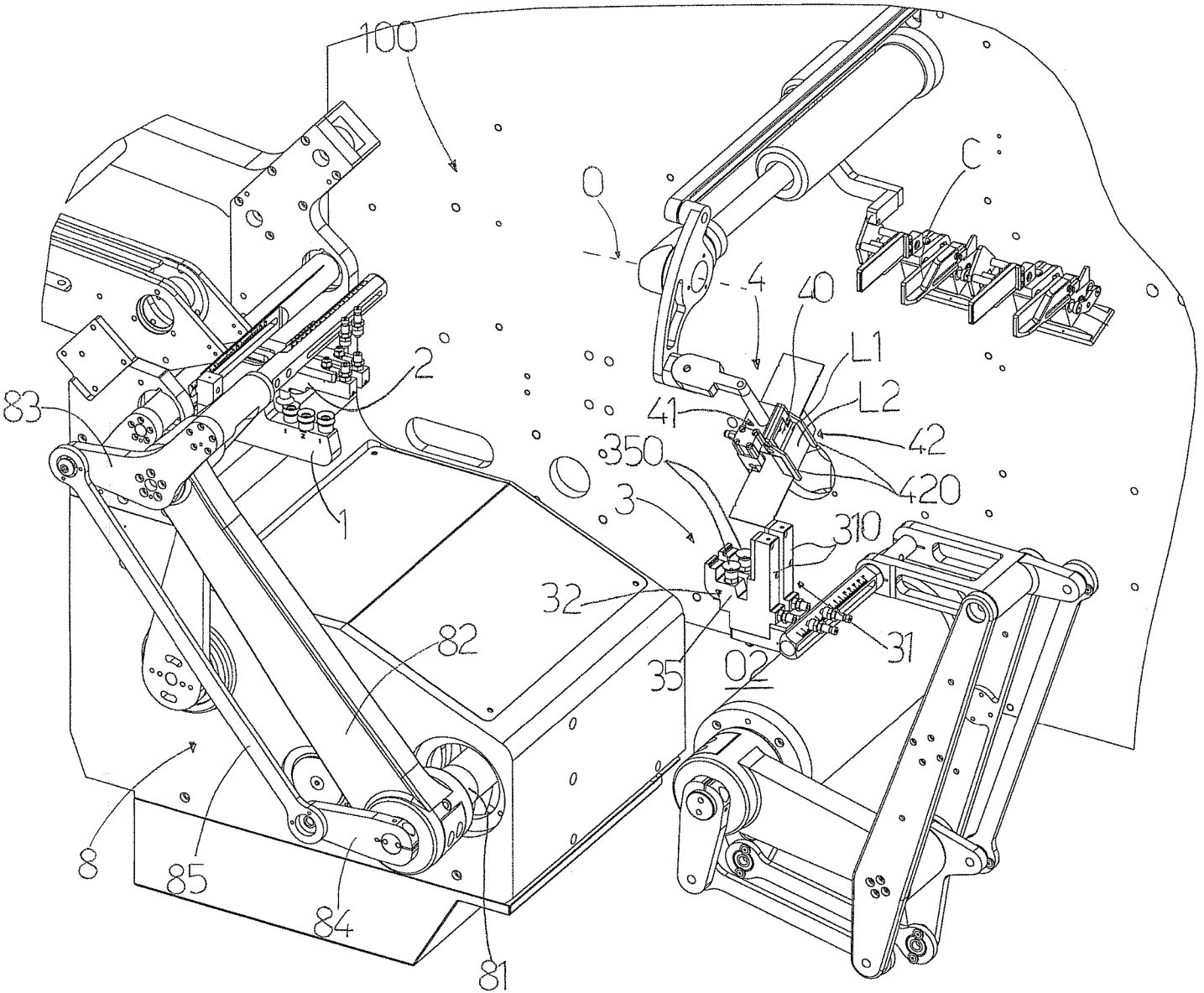
Figure 3H:
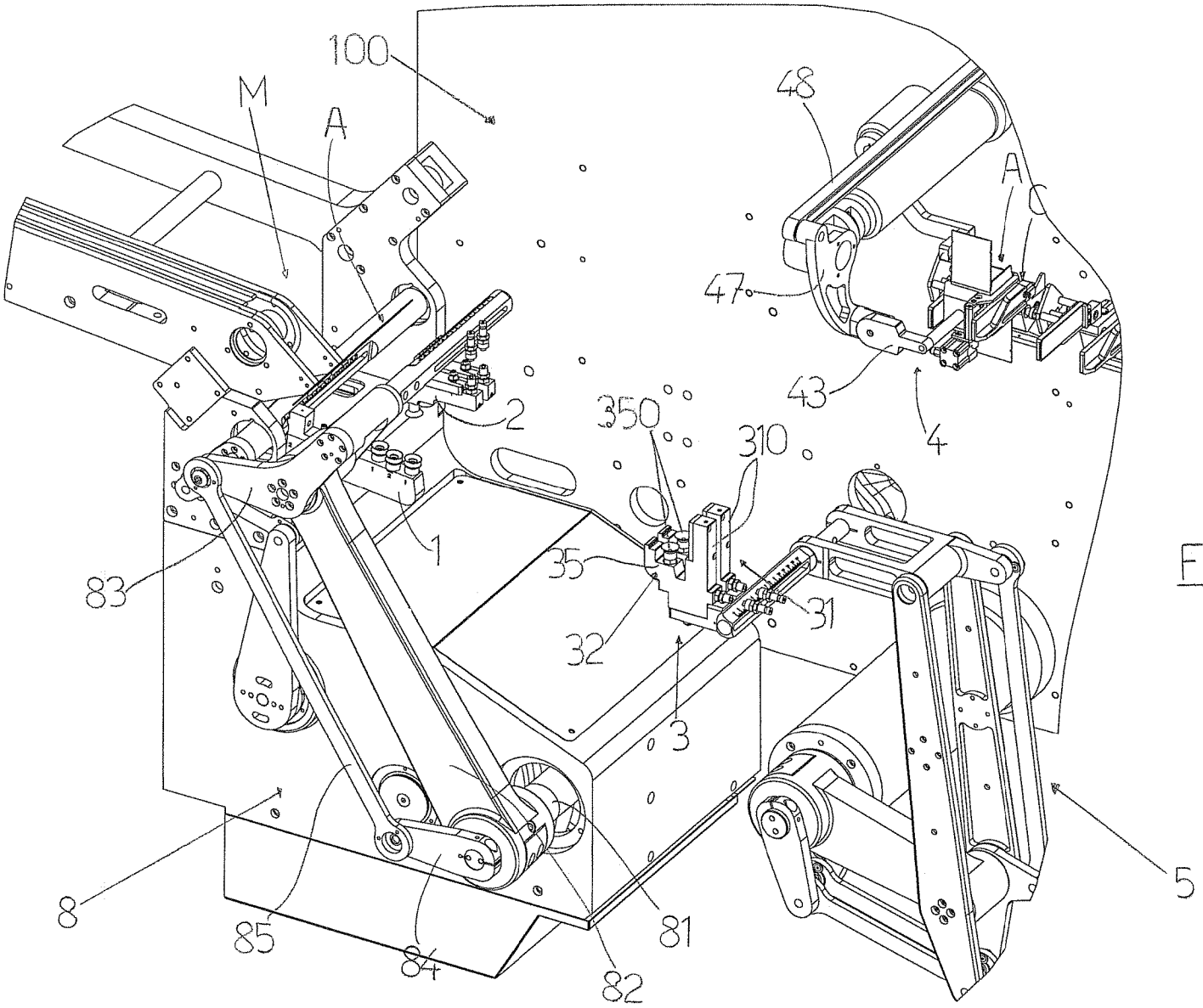

With reference to the appended tables of drawings, in particular FIGS. 2 to 3H, reference numeral (100) denotes the apparatus for collecting containers (A) in the flattened configuration and for the opening-out of the containers (A), object of the present invention, in its entirety.

As indicated in the foregoing, the containers (A) in the flattened configuration are constituted by two sheets (A1, A2), for example made of cardboard or card, which are connected to one another by means of relative folding lines.

The two sheets (A1, A2) are folded with respect to the folding lines so as to be in contact with one another and facing one another, defining a flattened configuration for the containers (A).

Further, each of the two sheets (A1, A2) also comprises a further folding line that is such as to identify thereon a first face (F1) and a second face (F2), separated by the folding line and foldable with respect thereto.

The apparatus (100) comprises: a store (M), which is predisposed so as to contain the flattened containers (A), and an extracting means (1) of the containers (A) from the store (M), for extracting a container (A) at a time from the store (M).

In the appended figures of the drawings, the store (M) is illustrated schematically and only the first flattened container (A) of the line of stacked containers internally of the store (M) is illustrated inside it; this first container (A) is located at the open end of the store (M) with a first sheet (A1) of the superposed two sheets (A1, A2) facing towards the outside.

The extracting means (1) is configured and activatable (by a relative activating group not described in detail as of known type) so as to abut a flattened container (A) present in the store (M) at a first sheet (A) of the two sheets (A1, A2) facing one another, grippingly constraining the flattened container (A) at the first sheet (A1) (see FIG. 3A in this regard), extracting the flattened container (A) from the store and arranging the flattened container (A) in a waiting position (P1) with the first underlying sheet (A1) and the second overlying sheet (A2), and a first face (F1) present in the second overlying sheet (A2), connected to a first face of the first underlying sheet (A1) by a relative folding line, in a retracted position, and a second face (F2) present in the second overlying sheet (A2), connected to a second face of the first underlying sheet (A1) by a relative folding line, in an advanced position (see for example FIG. 3B).

A first special aspect of the apparatus (100) of the present invention consists in the fact that it comprises a container (A) transfer means (2), movable between a first upstream position (PM) for collecting containers (A) and a second downstream position (PV) for releasing containers (A), for transferring the containers (A) from the first upstream position (PM) to the second downstream position (PV).

In particular, the transfer means (2) is configured so that, when it is in the first upstream position (PM), it is above the flattened container (A) in the waiting position (P1) and can abut the second overlying sheet (A2) of the flattened container (A) at the first backward face (F1) of the second overlying sheet (A2), grippingly constraining the first backward face (F1) of the second overlying sheet (A2) so as to be able to transfer the container (A) downstream, constraining the container (A) by the first sheet (F1), maintaining the container (A) such that the folding line between the second forward face (F2) of the second overlying sheet (A2) and the second face of the first underlying sheet (A1) is in an advanced position, up to the second downstream position (PV), then to release the retracted first face (F1) of the second overlying sheet (A2) and therefore the container (A), once having reached the second downstream position (PV).

In this way, once the extracting means (1) has extracted the flattened container (A) from the store (M) and has placed the container (A) in the waiting position (P1) with the second overlying sheet (A2), the transfer means (2), predisposed and positioned in the first upstream position (PM) thereof, can abut the retracted first face (F1) of the second overlying sheet (A2), and retain the first face (F1) by gripping it, in order to collect the container (A) from the extracting means (1).

Following this, the transfer means (2) can be moved towards the second downstream position (PV) thereof, in order to transfer the container (A) to the second downstream position (PV), retaining it by the first retracted face (F1) of the second overlying sheet (A2) (see the sequence of FIGS. 3B, 3C, 3D).

A further special aspect of the apparatus (100) is constituted by the fact that it comprises an opening-out device (3) of the container (A), comprising abutting means (31) and gripping means (32).

The opening-out device (3) is predisposed and configured so as to predispose and position the abutting means (31) and the gripping means (32) in a first operating work station (O1) in which the abutting means (31) are in a position along the transfer pathway of the container (A) by the transfer means (2), from the first upstream position (PM) to the second downstream position (PV), upstream (i.e. before) with respect to the second downstream position (PV) in which the transfer means (2) transfers and releases the container (A).

In this way, the abutting means (31) are abutted by the container (A), during transfer thereof towards the second downstream position (PV)(see for example FIG. 3C), at the folding line between the second forward face (F2) of the second overlying sheet (A2) and the second face of the first underlying sheet (A1), so that subsequently, during the further advancement of the container (A) by the transfer means (2) up to the second downstream position (PV) (see FIG. 3D, after 3C), the abutting means (31) cause a rotation, and therefore the folding of the second forward face (F2) of the second overlying sheet (A2) both with respect to the first backward face (F1) of the second overlying sheet (A2), still constrained by the transfer means (2), and with respect to the second face of the first underlying sheet (A1) connected thereto.

With this relative movement of the container (A), moved by the transfer means (2), with respect to the abutting means (31) of the opening-out device (3), the opening-out of the container (A) is achieved, exploiting only the conformation of the container (A) itself, by folding, in a natural way, the various faces of the two sheets along the relative folding lines which separate them one from the other.

The advancement of the transfer means (2), up to the second downstream position PV) thereof, determines the positioning of the second forward face (F2) of the second overlying sheet (A2) in contact with and in abutment against the abutting means (31) and the second face of the first underlying sheet (A1) in an opposite and parallel position with respect to the first backward face (F1) of the second overlying sheet (A2) constrained by the transfer means (2).

The above-mentioned gripping means (32) are predisposed, once the open container (A) has reached this position and is in the opened-out configuration, for abutting and grippingly constraining the second face of the first underlying sheet (A1), so as to maintain squared one to another the second face (F2) of the second overlying sheet (A2), in abutment against the abutting means (31), and the second face of the first underlying sheet (A1), parallel to the first backward face (F1) of the second overlying sheet (A2), once the transfer means (2) has released the first backward face (F1) of the second overlying sheet (A2) so as to return into the first upstream position (PM).

In this way, the opened-out container (A) is maintained in the open configuration, and opened-out with the relative horizontal axis, due to the grip of the gripping means (32) and the contemporaneous abutment provided by the abutting means (31) on two consecutive respectively-squared faces of the container, which because of the natural conformation the container had when in the flattened configuration in the store, would naturally tend to fold with respect to one another in order to return the container into the starting flattened configuration (FIG. 3D).

This way of, opening-out the container is without doubt more effective than the prior art, as the opening-out is achieved by exploiting the container conformation, and therefore is done in an extremely rapid and natural way, without any effort or opposing resistance.

Therefore the opened-out container (A) will comprise: a lower wall (L1), constituted by the second face of the first underlying sheet (A1), constrained by the gripping means (32), a first lateral wall (L2), constituted by the second forward face (F2) of the second overlying sheet (A2), in contact and abutting against the abutting means (31), a second lateral wall (L3), constituted by the first face of the first underlying sheet (A1), parallel to the first lateral wall (L1), and an upper wall (L4), constituted by the first backward face (F1) of the second overlying sheet (A2), parallel to the lower wall (L1).

Lastly, the apparatus (100) includes a collecting device (4), predisposed so as to collect the container (A) opened out by the opening-out device (3) and transfer the opened out container by rotating it, with the axis thereof vertical, to a crate (C) of a packing line, (see for example the sequence of FIGS. 3F to 3H).

Further special and advantageous characteristics of the apparatus (100) disclosed by the present invention are set out in the following.

The collecting device (4) of the opened-out container (A) from the opening-out device (3) comprises: collecting means (41) which are predisposed and configured so as to abut and grippingly constrain the upper wall (L4) of the opened-out container (A), and holding elements (42) predisposed and configured with respect to the collecting means (41) so as to go into contact and in abutment against the first lateral wall (L2) of the opened-out container (A) when the collecting means (41) abut the upper wall (L4) of the container (A).

The upper wall (L4) and the first lateral wall (L2)' are kept squared to one another, and therefore the container (A) is maintained opened-out during activation of the collecting device (4), for collecting the container (A) from the opening-out device (3) and for transfer and rotation thereof into the vertical position at a crate (C) of the packaging line.

The collecting device (4) further comprises a support element (43), for support of the collecting means (41) and the holding elements (42), which is activatable in rotation about a horizontal rotation axis (O), and activating means (44) for activating the rotation of the support element (43) about the horizontal rotation axis (O), so as to be able to rotate the opened-out container (A) from a configuration having a horizontal axis to a configuration having a vertical axis, once the collecting means (41) have abutted and grippingly constrained the upper wall (L4) of the container (A) and the holding elements (42) are in contact and in abutment against the first lateral wall (L2) of the container (A).

The collecting device (4) further comprises translation movement means (45) of the support element (43), which are activatable for translating the support element (43) once the activating means (44) in rotation have rotated the support element (43) with respect to the horizontal rotation axis (O) and brought the opened-out container (A) into the vertical configuration, so as to translate and transfer the opened-out container (A) in vertical configuration to a crate (C) of the packing line.

According to the preferred but not exclusive embodiment illustrated in the drawings, the translation movement means (45) of the support element (43) comprise a stem (46) movable by an actuator (not illustrated as it can be constituted by an actuator of any known type), while the activating means (44) for activating the rotation of the support element (43) comprise a con rod element (47), centrally hinged to an end of the stem (46) according to the horizontal rotation axis (O), connected at a first end to the support element (43) and constrained at a second end to a rod (48) activatable in translation by a relative actuator means (also not illustrated as it can be constituted by an actuator of any known type).

In a further preferred aspect, the opening-out device (3) of the containers is configured and predisposed for horizontally translating the abutting means (31) and the gripping means (32) from the first operating work station (O1), in which the container (A) is opened out, to a second operating work station (O2), retracted and distanced with respect to the second downstream position (PV) in which the transfer means (2) transfers and releases the container (A).

In particular, in an especially preferred and advantageous aspect, the opening-out device (3) being predisposed and configured, once the container (A) has been opened out, in such a way as to horizontally translate (V) the abutting means (31) and the gripping means (32) from the first operating work station (O1) to the second operating work station (O2), so that the opened-out container (A) is maintained in opened-out configuration by the gripping means (32) and the abutting means (31) is brought into the second operating work station (O2).

In this case, the collecting device (4) is predisposed and configured for bringing the collecting means (41) and the holding elements (42) to the second operating work station (O2) in advance with respect to the arrival of the gripping means (32) and the abutting means (31) of the opening-out device (3) which bring the opened-out container (A) into the second operating work station (O2).

With this specification, the collecting and transferring operations of the opened-out container take place in a different zone from the point where the container is completely opened-out because of the relative motion of the transfer means with respect to the abutting means of the opening-out device positioned in the first operating work station (O1), and therefore can be carried out more rapidly as they are not impeded by the presence of other operating means (such as the transfer means (2) itself).

In other preferred and advantageous aspects, the abutting means (31) of the opening-out device (3) comprise at least a vertical abutting element (310) while the gripping means (32) of the opening-out device (3) comprise at least an arm (35) arranged perpendicularly to the vertical abutting element (310) and provided with the gripping and holding means (350).

In turn, the collecting means (41) of the collecting device (4) comprise a plate (40) provided with relative gripping and holding elements (not illustrated in detail as of known type) while the holding elements (42) comprise at least a vertical rib (420) arranged perpendicularly to the plate (40).

In particular, according to the preferred embodiment illustrated in the figures, the abutting means (31) of the opening-out device (3) comprise a pair of vertical abutting elements (310) distanced from one another, while the holding elements (42) of the collecting device (4) comprise in turn a pair of vertical ribs (420) distanced from one another.

In greater detail, the pair of vertical ribs (420) of the collecting device (4) is arranged with respect to the pair of vertical abutting elements (310) of the opening-out device (3) in such a way that, when the collecting device (4) is brought into the second operating work station (O2) awaiting arrival of the opening-out device (3), the ribs (420) of the pair of vertical ribs (420) are in an offset position with respect to the vertical abutting elements (310) of the pair of vertical abutting elements (310) when the opening-out device (3) arrives in the second operating work station (O2) (see for example FIG. 3).

In this way, the vertical ribs (420) of the holding elements (42) of the collecting device (4) abut the first lateral wall (L2) of the opened-out container (A) while the first lateral wall (L2) is still retained in abutment against the pair of vertical abutting elements (310) of the abutting means (31) of the opening-out device (3).

This guarantees maintaining the full opening-out, i.e. the maintaining of the squared position between the first lateral wall (L2) and the lower wall (L1) during the passage of the container from the opening-out device (3) and the collecting device (4).

Other preferred and special aspects of the apparatus (100) of the invention are the following.

The opening-out device (3) comprises an activating group (5) for moving the gripping means (32) and the abutting means (31), the activating group (5) being configured and predisposed in such a way as to move the gripping means (32) and the abutting means (31) from the first operating work station (O1) to the second operating work station (O2) along a first horizontal translation trajectory (V), and to move the gripping means (32) and the abutting means (31) from the second operating work station (O2) to the first operating work station (O1) along a second movement arched trajectory below the first horizontal translation trajectory.

In this regard, the activating group (5) comprises:

a support means (51) for supporting the gripping means and the abutting means (31);

a first hinged system (52) constrained to the support means (51);

a second hinged system (53) kinematically coupled to the first hinged system (52) and constrained to a first shaft (54) activatable in rotation in two opposite rotation directions for activating the second hinged system (53) and the first hinged system (52), and therefore for moving the support means (51);

first trajectory correcting means (55) kinematically connected to the first hinged system (52) and connected to the first shaft (54);

and second trajectory correcting means (56) kinematically connected to the first hinged system (52).

The first hinged system (52) and the second hinged system (53) being configured and predisposed so as to move the support means (51), and therefore the gripping means (32) and the abutting means (31), from the first operating work station (O1) to the second operating work station (O2), when the first shaft (54) is activated in a first rotation direction, and so as to move the support means (51), and therefore the gripping means (32) and the abutting means (31), from the second operating work station (O2) to the first operating work station (O1), when the first shaft (54) is activated in a second rotation direction.

The first trajectory correcting means (55) and the second trajectory correcting means (56) are predisposed, with respect to the first hinged system (52) and the second hinged system (53), so that the support means (51) is moved from the first operating work station (O1) to the second operating work station (O2) so as to follow a horizontal trajectory (V) so that the gripping means (32) and the abutting means (31) are moved along the first horizontal translation trajectory (V), maintaining the opened-out container (A) with the axis thereof horizontal.

According to the preferred embodiment illustrated in the appended figures of the drawings, see for example FIGS. 3B, 3E, 3F, the first hinged system (52) comprises: a first member (61), hinged to the support means (51), a second member (62), hinged to the support means (51) and parallel to the first member (61) and having a greater extension than the first member (61), a third member (63), hinged to the lower end of the first member (61), and exhibiting an appendage (630).

In turn the second hinged system (53) comprises: a fourth member (64) constrained to the first shaft (54) and hinged to the second member (62) of the first hinged system (52) and to the first member (61) and to the third member (63), at the hinge point thereof, of the first hinged system (52), a fifth member (65) parallel to the fourth member (64) and hinged to the third member (63) of the first hinged system (52), a sixth member (66) hinged to the fifth member (65) and constrained to the first shaft (54).

The first trajectory correcting means (55) comprise: a first connecting member (67), hinged to the lower end of the second member (62) of the first hinged system (52), and a second connecting member (68) constrained to the first shaft (54) and hinged to the first connecting member (67) in such a way that the first connecting member (67) is parallel to the fifth member (65) of the second hinged system (53), and in that the second trajectory correcting means (56) comprise: a third connecting member (69), connected to the support means (51) at the hinge point of the first member (61) of the first hinged system (52), and a fourth connecting member (70) hinged to the third connecting member (69) and to the appendage (630) of the third member (63) of the first hinged system (52) so as to be parallel to the first member (61) of the first hinged system (52).

According to the preferred embodiment illustrated in the accompanying figures, the apparatus further comprises an activating and movement system (8) of the transfer means (2), comprising: a second shaft (81) activatable in rotation according to opposite directions, a first arm (82) constrained at a first end thereof to the second shaft (81), a V-shaped second arm (83) hinged centrally to the second end of the first arm (82), a third arm (84) hinged to the first arm (82) at the constrained point thereof with the second shaft (81), a fourth arm (85) hinged to the third arm (84) and to an end of the V-shaped second arm (83) in such a way as to be parallel to the first arm (82), the transfer means (2) being brought to and coupled to the second end of the V-shaped second arm (83)(see for example FIGS. 3C, 3D, 3G, 3H).

The invention claimed is:

1. An apparatus for collecting containers in a flattened configuration and for opening out containers, comprising:

a store, predisposed for containing containers in a flattened configuration, the containers being in the flattened configuration constituted by two sheets connected to one another by means of relative folding lines, the two sheets being folded with respect to the folding lines to be in contact with and facing one another, each of the two sheets also comprising a further folding line identifying on each of the two sheets a first face and a second face separated by the folding line and foldable with respect thereto;

extracting means for extracting one container in the flattened configuration at a time from the store, configured and activatable to abut a flattened container present in the store at a first sheet of the two sheets facing one another, the extracting means including grippers grippingly constraining the flattened container at the first sheet, extracting the flattened container from the store and arranging the flattened container in a waiting position with the first underlying sheet and the second overlying sheet, and a first face present in the second overlying sheet, connected to a first face of the first underlying sheet by a relative folding line, in a retracted position, and a second face present in the second overlying sheet, connected to a second face of the first underlying sheet by a relative folding line, in an advanced position;

container transfer means, movable and positionable between a first upstream position for collecting containers and a second downstream position for releasing containers, for transferring the containers from the first upstream position to the second downstream position, wherein the container transfer means are configured so that, when the container transfer means is moved and positioned in the first upstream position, the container transfer means is located above the flattened container in the waiting position and can abut the second overlying sheet of the flattened container at the first backward face of the second overlying sheet, the container transfer means being configured for subsequently moving the flattened container by grippingly constraining the first backward face of the second overlying sheet to transfer the flattened container downstream, maintaining the flattened container with the folding line between the second forward face of the second overlying sheet and the second face of the first underlying sheet in an advanced position, up to the second downstream position and for then releasing the first backward face of the second overlying sheet once having reached the second downstream position;

a container-opening-out device comprising abutting means and gripping means, the container-opening-out device being predisposed and configured to predispose and position the abutting means and the gripping means in a first operating work station in which the abutting means are in a position along the transfer pathway of the flattened container by the container transfer means, from the first upstream position to the second downstream position, upstream with respect to the second downstream position in which the container transfer means transfers and releases the flattened container, the abutting means being abutted by the flattened container, during transfer thereof towards the second downstream position, at the folding line between the second forward face of the second overlying sheet and the second face of the first underlying sheet, so that subsequently, during the further advancement of the flattened container by the container transfer means up to the second downstream position, the abutting means being configured to cause a rotation, and therefore the folding of the second forward face of the second overlying sheet both with respect to the first backward face of the second overlying sheet, constrained by the container transfer means, and with respect to the second face of the first underlying sheet connected thereto, with a consequent opening out of the flattened container into an opened-out configuration in which the second forward face of the second overlying sheet is disposed in contact with and in abutment against the abutting means and in which the second face of the first underlying sheet is disposed in an opposite and parallel position with respect to the first backward face of the second overlying sheet constrained by the container transfer means, the gripping means being predisposed and configured for abutting and grippingly constraining the second face of the first underlying sheet to maintain squared one to another the second face of the second overlying sheet, in abutment against the abutting means, and the second face of the first underlying sheet, parallel to the first backward face of the second overlying sheet, once the container transfer means has released the first backward face of the second overlying sheet for returning back into the first upstream position, and therefore maintaining the container in the opened-out configuration with the relative horizontal axis, so that the opened-out container comprises: a lower wall, constituted by the second face of the first underlying sheet, constrained by the gripping means, a first lateral wall, constituted by the second forward face of the second overlying sheet, in contact and abutting against the abutting means, a second lateral wall, constituted by the first face of the first underlying sheet, parallel to the first lateral wall, and an upper wall, constituted by the first backward face of the second overlying sheet, parallel to the lower wall; and a collecting device, predisposed to collect the opened-out container and transfer the opened-out container by rotating the opened-out container with the axis thereof vertical to a crate of a packing line, by maintaining the opened-out container in the opened-out configuration.

2. The apparatus of claim 1, wherein the collecting device comprises:

collecting means which are predisposed and configured to abut and grippingly constrain the upper wall of the opened-out container and holding elements predisposed and configured with respect to the collecting means to go into contact and in abutment against the first lateral wall of the opened-out container when the collecting means abut the upper wall of the container, to maintain these two walls squared to one another, and therefore maintain the container opened-out, during collection thereof from the container-opening-out device and during transfer of the opened-out container with vertical rotation to the crate of the packing line.

3. The apparatus of claim 2, wherein the collecting device further comprises a support element, for support of the collecting means and the holding elements, activatable in rotation about a horizontal rotation axis, and activating means for activating the rotation of the support element about the horizontal rotation axis, to rotate the opened-out container from a configuration having a horizontal axis to a configuration having a vertical axis, once the collecting means have abutted and grippingly constrained the upper wall of the container and the holding elements are in contact and in abutment against the first lateral wall of the container.

4. The apparatus of claim 3, wherein the collecting device of the opened-out container further comprises translation movement means of the support element, activatable for translating the support element once the activating means in rotation have rotated the support element with respect to the horizontal rotation axis and brought the opened-out container into the vertical configuration, to translate and transfer the opened-out container in vertical configuration to a crate of the packing line.

5. The apparatus of claim 2, wherein the container-opening-out device of the containers is configured and predisposed for horizontally translating the abutting means and the gripping means from the first operating work station, wherein the container is opened out, to a second operating work station, retracted and distant from the second downstream position wherein the container transfer means transfers and releases the container, the container-opening-out device being predisposed and configured, once the container has been opened out, to horizontally translate the abutting means and the gripping means from the first operating work station to the second operating work station, so that the opened-out container is maintained in opened-out configuration by the gripping means and the abutting means is brought into the second operating work station, and wherein the collecting device is predisposed and configured for bringing the collecting means and the holding elements to the second operating work station in advance with respect to the gripping means and the abutting means of the container-opening-out device which bring the opened-out container into the second operating work station.

6. The apparatus of claim 5, wherein the abutting means of the container-opening-out device comprise at least a vertical abutting element and wherein the gripping means of the container-opening-out device comprise at least an arm arranged perpendicularly to the vertical abutting element and provided with the gripping and holding means, and wherein the collecting means of the collecting device comprise a plate provided with relative gripping and holding elements and wherein the holding elements comprise at least a vertical rib arranged perpendicularly to the plate.

7. The apparatus of claim 5, wherein the container-opening-out device comprises an activating group for moving the gripping means and the abutting means, the activating group being configured and predisposed to move the gripping means and the abutting means from the first operating work station to the second operating work station along the first horizontal translation trajectory, and to move the gripping means and the abutting means from the second operating work station to the first operating work station along a second movement arched trajectory below the first horizontal translation trajectory.

8. The apparatus of claim 7, wherein the activating group for moving the gripping means and the abutting means comprises:

a support means for supporting the gripping means and the abutting means;

a first hinged system constrained to the support means;

a second hinged system kinematically coupled to the first hinged system and constrained to a first shaft activatable in rotation in two opposite rotation directions for activating the second hinged system and the first hinged system, and therefore for moving the support means;

first trajectory correcting means kinematically connected to the first hinged system and connected to the first shaft; and second trajectory correcting means kinematically connected to the first hinged system, the first hinged system and the second hinged system being configured and predisposed to move the support means, and therefore the gripping means and the abutting means, from the first operating work station to the second operating work station, when the first shaft is activated in a first rotation direction, and so, as to move the support means, and therefore the gripping means and the abutting means, from the second operating work station to the first operating work station, when the first shaft is activated in a second rotation direction, with the first trajectory correcting means and the second trajectory correcting means being predisposed to move the support means from the first operating work station to the second operating work station with a horizontal trajectory so that the gripping means and the abutting means are moved along the first horizontal translation trajectory, maintaining the opened-out container with the axis thereof horizontal.

9. The apparatus of claim 8, wherein the first hinged system comprises:

a first member, hinged to the support means, a second member, hinged to the support means and parallel to the first member and having a greater extension than the first member, a third member, hinged to the lower end of the first member, and exhibiting an appendage;

wherein the second hinged system comprises:

a fourth member constrained to the first shaft and hinged to the second member of the first hinged system and to the first member and to the third member, at the hinge point thereof, of the first hinged system, a fifth member parallel to the fourth member and hinged to the third member of the first hinged system, a sixth member hinged to the fifth member and constrained to the first shaft;

wherein the first trajectory correcting means comprise:

a first connecting member hinged to the lower end of the second member of the first hinged system and a second connecting member constrained to the first shaft and hinged to the first connecting member in such a way that the first connecting member is parallel to the fifth member of the second hinged system, and wherein the second trajectory correcting means comprise:

a third connecting member, connected to the support means at the hinge point of the first member of the first hinged system, and a fourth connecting member hinged to the third connecting member and to the appendage of the third member of the first hinged system to be parallel to the first member of the first hinged system.

10. The apparatus of claim 1, further comprising an activating and movement system of the container transfer means, comprising:

a second shaft activatable in rotation according to opposite directions, a first arm constrained at a first end thereof to the second shaft, a V-shaped second arm hinged centrally to the second end of the first arm, a third arm hinged to the first arm at the constrained point thereof with the second shaft, a fourth arm hinged to the third arm and to an end of the V-shaped second arm in such a way as to be parallel to the first arm, the container means being brought to and coupled to the second end of the V-shaped second arm.

11. An apparatus for collecting containers in a flattened configuration and for opening out containers, comprising:

a store, predisposed for containing containers in a flattened configuration, the containers being in the flattened configuration constituted by two sheets connected to one another by means of relative folding lines, the two sheets being folded with respect to the folding lines to be in contact with and facing one another, each of the two sheets also comprising a further folding line identifying on each of the two sheets a first face and a second face separated by the folding line and foldable with respect thereto;

extracting means for extracting one container in the flattened configuration at a time from the store, configured and activatable to abut a flattened container present in the store at a first sheet of the two sheets facing one another, the extracting means including gripers grippingly constraining the flattened container at the first sheet, extracting the flattened container from the store and arranging the flattened container in a waiting position with the first underlying sheet and the second overlying sheet, and a first face present in the second overlying sheet, connected to a first face of the first underlying sheet by a relative folding line, in a retracted position, and a second face present in the second overlying sheet, connected to a second face of the first underlying sheet by a relative folding line, in an advanced position;

container transfer means, movable and positionable between a first upstream position for collecting containers and a second downstream position for releasing containers, for transferring the containers from the first upstream position to the second downstream position, wherein the container transfer means are configured so that, when the container transfer means is moved and positioned in the first upstream position, the container transfer means is located above the flattened container in the waiting position and can abut the second overlying sheet of the flattened container at the first backward face of the second overlying sheet, the container transfer means being configured for subsequently moving the flattened container by grippingly constraining the first backward face of the second overlying sheet to transfer the flattened container downstream, maintaining the flattened container with the folding line between the second forward face of the second overlying sheet and the second face of the first underlying sheet in an advanced position, up to the second downstream position and for then releasing the first backward face of the second overlying sheet once having reached the second downstream position;

a container-opening-out device comprising abutting means and gripping means, the container-opening-out device being predisposed and configured to predispose and position the abutting means and the gripping means in a first operating work station in which the abutting means are in a position along the transfer pathway of the flattened container by the container transfer means, from the first upstream position to the second downstream position, upstream with respect to the second downstream position in which the container transfer means transfers and releases the flattened container, the abutting means being abutted by the flattened container, during transfer thereof towards the second downstream position, at the folding line between the second forward face of the second overlying sheet and the second face of the first underlying sheet, so that subsequently, during the further advancement of the flattened container by the container transfer means up to the second downstream position, the abutting means being configured to cause a rotation, and therefore the folding of the second forward face of the second overlying sheet both with respect to the first backward face of the second overlying sheet, constrained by the container transfer means, and with respect to the second face of the first underlying sheet connected thereto, with a consequent opening out of the flattened container into an opened-out configuration in which the second forward face of the second overlying sheet is disposed in contact with and in abutment against the abutting means and in which the second face of the first underlying sheet is disposed in an opposite and parallel position with respect to the first backward face of the second overlying sheet constrained by the container transfer means, the gripping means being predisposed and configured for abutting and grippingly constraining the second face of the first underlying sheet to maintain squared one to another the second face of the second overlying sheet, in abutment against the abutting means, and the second face of the first underlying sheet, parallel to the first backward face of the second overlying sheet, once the container transfer means has released the first backward face of the second overlying sheet for returning back into the first upstream position, and therefore maintaining the container in the opened-out configuration with the relative horizontal axis, so that the opened-out container comprises: a lower wall, constituted by the second face of the first underlying sheet, constrained by the gripping means, a first lateral wall, constituted by the second forward face of the second overlying sheet, in contact and abutting against the abutting means, a second lateral wall, constituted by the first face of the first underlying sheet, parallel to the first lateral wall, and an upper wall, constituted by the first backward face of the second overlying sheet, parallel to the lower wall; and a collecting device, predisposed to collect the opened-out container and transfer the opened-out container by rotating the opened-out container with the axis thereof vertical to a crate of a packing line, by maintaining the opened-out container in the opened-out configuration, wherein the collecting device comprises:

collecting means which are predisposed and configured to abut and grippingly constrain the upper wall of the opened-out container and holding elements predisposed and configured with respect to the collecting means to go into contact and in abutment against the first lateral wall of the opened-out container when the collecting means abut the upper wall of the container, to maintain these two walls squared to one another, and therefore maintain the container opened-out, during collection thereof from the container-opening-out device and during transfer of the opened-out container with vertical rotation to the crate of the packing line, wherein the collecting device further comprises a support element, for support of the collecting means and the holding elements, activatable in rotation about a horizontal rotation axis, and activating means for activating the rotation of the support element about the horizontal rotation axis, to rotate the opened-out container from a configuration having a horizontal axis to a configuration having a vertical axis, once the collecting means have abutted and grippingly constrained the upper wall of the container and the holding elements are in contact and in abutment against the first lateral wall of the container, wherein the collecting device of the opened-out container further comprises translation movement means of the support element, activatable for translating the support element once the activating means in rotation have rotated the support element with respect to the horizontal rotation axis and brought the opened-out container into the vertical configuration, to translate and transfer the opened-out container in vertical configuration to a crate of the packing line, wherein the translation movement means of the support element comprise a stem movable by an actuator, and wherein the activating means for activating the rotation of the support element comprise a con rod element, centrally hinged to an end of the stem according to the horizontal rotation axis, connected at a first end to the support element and constrained at a second end to a rod activatable in translation by a relative actuator means.

12. An apparatus for collecting containers in a flattened configuration and for opening out containers, comprising:

a store, predisposed for containing containers in a flattened configuration, the containers being in the flattened configuration constituted by two sheets connected to one another by means of relative folding lines, the two sheets being folded with respect to the folding lines to be in contact with and facing one another, each of the two sheets also comprising a further folding line identifying on each of the two sheets a first face and a second face separated by the folding line and foldable with respect thereto;

extracting means for extracting one container in the flattened configuration at a time from the store, configured and activatable to abut a flattened container present in the store at a first sheet of the two sheets facing one another, the extracting means including grippers grippingly constraining the flattened container at the first sheet, extracting the flattened container from the store and arranging the flattened container in a waiting position with the first underlying sheet and the second overlying sheet, and a first face present in the second overlying sheet, connected to a first face of the first underlying sheet by a relative folding line, in a retracted position, and a second face present in the second overlying sheet, connected to a second face of the first underlying sheet by a relative folding line, in an advanced position;

container transfer means, movable and positionable between a first upstream position for collecting containers and a second downstream position for releasing containers, for transferring the containers from the first upstream position to the second downstream position, wherein the container transfer means are configured so that, when the container transfer means is moved and positioned in the first upstream position, the container transfer means is located above the flattened container in the waiting position and can abut the second overlying sheet of the flattened container at the first backward face of the second overlying sheet, the container transfer means being configured for subsequently moving the flattened container by grippingly constraining the first backward face of the second overlying sheet to transfer the flattened container downstream, maintaining the flattened container with the folding line between the second forward face of the second overlying sheet and the second face of the first underlying sheet in an advanced position, up to the second downstream position and for then releasing the first backward face of the second overlying sheet once having reached the second downstream position;

a container-opening-out device comprising abutting means and griping means, the container-opening-out device being predisposed and configured to predispose and position the abutting means and the gripping means in a first operating work station in which the abutting means are in a position along the transfer pathway of the flattened container by the container transfer means, from the first upstream position to the second downstream position, upstream with respect to the second downstream position in which the container transfer means transfers and releases the flattened container, the abutting means being abutted by the flattened container, during transfer thereof towards the second downstream position, at the folding line between the second forward face of the second overlying sheet and the second face of the first underlying sheet, so that subsequently, during the further advancement of the flattened container by the container transfer means up to the second downstream position, the abutting means being configured to cause a rotation, and therefore the folding of the second forward face of the second overlying sheet both with respect to the first backward face of the second overlying sheet, constrained by the container transfer means, and with respect to the second face of the first underlying sheet connected thereto, with a consequent opening out of the flattened container into an opened-out configuration in which the second forward face of the second overlying sheet is disposed in contact with and in abutment against the abutting means and in which the second face of the first underlying sheet is disposed in an opposite and parallel position with respect to the first backward face of the second overlying sheet constrained by the container transfer means, the gripping means being predisposed and configured for abutting and grippingly constraining the second face of the first underlying sheet to maintain squared one to another the second face of the second overlying sheet, in abutment against the abutting means, and the second face of the first underlying sheet, parallel to the first backward face of the second overlying sheet, once the container transfer means has released the first backward face of the second overlying sheet for returning back into the first upstream position, and therefore maintaining the container in the opened-out configuration with the relative horizontal axis, so that the opened-out container comprises: a lower wall, constituted by the second face of the first underlying sheet, constrained by the gripping means, a first lateral wall, constituted by the second forward face of the second overlying sheet, in contact and abutting against the abutting means, a second lateral wall, constituted by the first face of the first underlying sheet, parallel to the first lateral wall, and an upper wall, constituted by the first backward face of the second overlying sheet parallel to the lower wall; and a collecting device, predisposed to collect the opened-out container and transfer the opened-out container by rotating the opened-out container with the axis thereof vertical to a crate of a packing line, by maintaining the opened-out container in the opened-out configuration, wherein the collecting device comprises:

collecting means which are predisposed and configured to abut and grippingly constrain the upper wall of the opened-out container and holding elements predisposed and configured with respect to the collecting means to go into contact and in abutment against the first lateral wall of the opened-out container when the collecting means abut the upper wall of the container, to maintain these two walls squared to one another, and therefore maintain the container opened-out, during collection thereof from the container-opening-out device and during transfer of the opened-out container with vertical rotation to the crate of the packing line, wherein the container-opening-out device of the containers is configured and predisposed for horizontally translating the abutting means and the gripping means from the first operating work station, wherein the container is opened out, to a second operating work station, retracted and distant from the second downstream position wherein the container transfer means transfers and releases the container, the container-opening-out device being predisposed and configured, once the container has been opened out, to horizontally translate the abutting means and the gripping means from the first operating work station to the second operating work station, so that the opened-out container is maintained in opened-out configuration by the gripping means and the abutting means is brought into the second operating work station, and wherein the collecting device is predisposed and configured for bringing the collecting means and the holding elements to the second operating work station in advance with respect to the gripping means and the abutting means of the container-opening-out device which bring the opened-out container into the second operating work station, wherein the abutting means of the container-opening-out device comprise at least a vertical abutting element and wherein the gripping means of the container-opening-out device comprise at least an arm arranged perpendicularly to the vertical abutting element and provided with the gripping and holding means, and wherein the collecting means of the collecting device comprise a plate provided with relative gripping and holding elements and wherein the holding elements comprise at least a vertical rib arranged perpendicularly to the plate, wherein the abutting means of the container-opening-out device comprise a pair of vertical abutting elements distanced from one another and wherein the holding elements of the collecting device in turn comprise a pair of vertical ribs distanced from one another, the pair of vertical ribs of the collecting device being arranged with respect to the pair of vertical abutting elements of the container-opening-out device so that, when the collecting device is brought into the second operating work station awaiting arrival of the container-opening-out device, the ribs of the pair of vertical ribs are in an offset position with respect to the vertical abutting elements of the pair of vertical abutting elements when the container-opening-out device arrives in the second operating work station, the vertical ribs abutting the first lateral wall of the opened-out container while the first lateral wall is still constrained in abutment against the pair of vertical abutting elements.

* * * * *